US005594298A

United States Patent [19]

Itoh et al.

[11] Patent Number: 5,594,298

[45] Date of Patent: Jan. 14, 1997

[54] FIELD EMISSION CATHODE DEVICE

[75] Inventors: Shigeo Itoh; Teruo Watanabe; Takahiro Niiyama, all of Mobara, Japan

[73] Assignee: Futaba Denshi Kogyo K.K., Mobara, Japan

[21] Appl. No.: 312,643

[22] Filed: Sep. 27, 1994

[30] Foreign Application Priority Data

Sep. 27, 1993 [JP] Japan ..... 5-260390

[51] Int. Cl.[6] ..... H01J 1/30

[52] U.S. Cl. ..... 313/336; 313/309; 313/351

[58] Field of Search ..... 313/309, 336, 313/351, 310, 495, 496

[56] References Cited

U.S. PATENT DOCUMENTS

| | | | |
|---|---|---|---|
| 4,940,916 | 7/1990 | Borel et al. | 313/336 |
| 5,142,184 | 8/1992 | Kane | 313/336 |
| 5,189,341 | 2/1993 | Itoh et al. | 315/169.1 |
| 5,194,780 | 3/1993 | Meyer | 313/336 |
| 5,256,936 | 10/1993 | Itoh et al. | 313/495 |

*Primary Examiner*—Nimeshkumar Patel

*Attorney, Agent, or Firm*—Oblon, Spivak, McClelland, Maier & Neustadt, P.C.

[57] ABSTRACT

A field emission cathode device capable of permitting when short-circuiting occurs between any of emitters and a gate, a block in which the block is formed to be separated from the remaining blocks and preventing a material fused at the time of the short-circuiting from scattering. A cathode conductor arranged on a substrate is formed with a plurality of cutouts, in which resistive layers are arranged. The resistive layers each are provided with terminals through which the resistive layer is connected to the cathode conductor. An insulating layer is arranged so as to cover the resistive layers and cathode conductor and a plurality of emitters are formed on each of the resistive layers. A gate conductor is formed on the insulating layer so as to be positioned around a distal end of each of the conical emitters. Short-circuiting between any of the emitters and the gate conductor causes the terminals to be fused. The insulating layer prevents the fused material from scattering.

5 Claims, 6 Drawing Sheets

FIELD EMISSION CATHODE DEVICE

BACKGROUND OF THE INVENTION

1. Field of the Invention

This invention relates to a field emission cathode device known as a cold cathode device, and more particularly to an improvement in a field emission cathode device.

2. Discussion of the Background

Application of an electric field of the order of about $10^9$ V/m to a surface of a metal material or a semiconductor material leads to a tunnel effect, to thereby permit electrons to pass through a barrier. This results in the electrons being discharged to a vacuum even at a normal temperature. Such a phenomenon is generally referred to as "field emission" and a cathode constructed so as to emit electrons based on such a principle is referred to as "field emission cathode" (hereinafter also referred to as "FEC").

Recently, semiconductor integration techniques permit an FEC of a size as small as microns to be produced.

Now, manufacturing of an FEC of the Spindt type which is an example of such a small-sized FEC by the semiconductor integration techniques will be described hereinafter with reference to FIGS. 5(*a*) to 5(*f*).

First, as shown in FIG. 5(*a*), a substrate 101 made of glass or the like is formed thereon with a cathode conductor 102, a resistive layer 103, an insulating layer or $SiO_2$ layer 104 and a gate conductor 105 by vapor deposition or the like in order. The cathode conductor 102 comprises a metal layer, the resistive layer 103 is formed of amorphous silicon or the like, the insulating layer 104 is made by subjecting silicon to thermal oxidation, and the gate conductor 105 comprises a metal layer of Nb or the like.

Then, the gate conductor 105 is coated thereon with a resist layer 106, followed by patterning as shown in FIG. 5(*b*). Subsequently, etching is carried out, resulting in an aperture 107 being formed through both the gate conductor 105 and insulating layer 104, followed by removal of the resist layer 106, as shown in FIG. 5(*c*).

Thereafter, a peel layer 109 is formed on the gate conductor 105 by depositing aluminum in a direction oblique to the substrate 101 while rotating the substrate 101. This permits the peel layer 109 to be formed on only a surface of the gate conductor 105 while being prevented from being formed in the aperture 107, as shown in FIG. 5(*d*). Then, deposition of Mo is carried out, resulting in a deposit layer 110 being formed on the peel layer 109 and an emitter deposit layer 111 of a conical shape being formed in the aperture 107, as shown in FIG. 5(*e*). Finally, the peel layer 109 and deposit layer 110 on the gate conductor 105 are removed by etching, so that an FEC may be provided as shown in FIG. 5(*f*).

Manufacturing of the FEC of FIG. 5(*f*) by the semiconductor integration techniques carried out as described above permits a distance between the conical emitter 111 and the gate conductor 105 to be defined to be as small as submicrons, so that application of a voltage of tens of volts between the emitter 111 and the gate conductor 105 may lead to emission of electrons from the emitter 111.

Such a construction of the FEC as shown in FIG. 5(*f*) permits FECs in number as many as tens of thousands to hundreds of thousands to be provided on a single substrate because a distance between each adjacent two emitters 111 may be defined to be as small as 5 to 10 microns.

This permits an FEC device of the surface discharge type in which a number of the FECs are incorporated to be manufactured, thus, it is proposed to apply it to a fluorescent display device, a CRT, an electron microscope, an electron beam device and the like.

Now, such an FEC device of the surface discharge type will be described hereinafter with reference to FIG. 6.

The FEC device includes a substrate 101, which is formed thereon with a cathode conductor 102. The cathode conductor 102 is then formed thereon with a resistive layer 103, on which emitters 111 each formed into a conical shape are provided. Also, the cathode conductor 102 is formed thereon with a gate conductor 105 through an insulating layer 104. The gate conductor 105 and insulating layer 104 are commonly formed with apertures 107 of a round shape so as to extend therethrough, through which the conical emitters 111 are exposed at a distal end thereof.

In the FEC device of the surface discharge type thus constructed, application of a driving voltage of tens of volts between the gate conductor 105 and the cathode conductor 102 permits each of the emitters 111 to emit electrons, which are then captured by an anode conductor 112 which is arranged so as to be upwardly spaced therefrom and to which an anode voltage $V_A$ is applied. Thus, when phosphors are arranged on the anode conductor 112, electrons captured by the anode conductor 112 permit the phosphors to emit light. The FEC device is so constructed that electrons travel in a space, thus, operation of the FEC device is carried out in a vacuum atmosphere.

Now, the reason why the resistive layer 103 is arranged between the emitters 111 and the cathode conductor 102 will be described hereinafter.

In general, each of the FECs of the FEC device is so constructed that a distance between the distal end of each of the conical emitters and the gate conductor is defined to be as small as submicrons and tens of thousands to hundreds of thousands of emitters are provided on the single substrate. Unfortunately, such a construction causes short-circuiting between any of the emitters and the gate conductor due to entrance of dust or the line into the FEC. Even when such short-circuiting occurs on only one emitter, short-circuiting is caused between the cathode conductor and the gate conductor, to thereby cause a failure in application of a voltage to all the emitters, leading to a failure in operation of the whole FEC device.

Also, the conventional FEC device often meets with a disadvantage that entrance of any gas into the device often occurs at an initial stage of operation of the FEC device, to thereby cause discharge between any of the emitters and the gate conductor or anode conductor, so that a large amount of current flows to the cathode conductor, leading to breakage of the cathode conductor.

Also, of a number of emitters, a part tends to readily emit electrons as compared with the remaining part. This results in electrons being concentratedly emitted from the part of the emitters, resulting in luminance on an image plane being non-uniform.

In view of the foregoing, it is considered that the resistive layer 103 is arranged between the cathode conductor 102 and the emitters 111 as shown in FIGS. 5(*a*) to 5(*f*) and FIG. 6. In such an arrangement, the resistive layer 103 leads to a voltage drop between the gate conductor 105 and the cathode conductor 102 when short-circuiting occurs between the emitters 111 and the gate conductor 105. A voltage due to the voltage drop is applied between a portion of the gate conductor 105 and that of the cathode conductor 102 at which emitters free from short-circuiting are arranged, so that the emitters free from short-circuiting may emit electrons. Further, the resistive layer 103 restrains a short-circuit current from flowing to the cathode conductor 102, to thereby prevent breakage of the cathode conductor 102.

Also, when a current is caused to concentratedly flow through any of the emitters as described above, the resistive layer 103 leads to a voltage drop of a significant magnitude across the emitter, so that a potential across the emitter is increased, resulting in a decrease in voltage between the portion of the gate conductor and that of the cathode conductor described above. This permits the emitter current to be reduced, to thereby prevent concentration of the emitter current.

Thus, it will be noted that arrangement of the resistive layer 103 improves yields in manufacturing of the FEC device and ensures stable operation of the FEC device.

In the conventional FEC device, the resistive layer 103 is arranged all over the substrate 101 as shown in FIG. 6. Unfortunately, such an arrangement of the resistive layer 103 causes operation of the emitters in a manner to be independent from each other to be highly difficult, resulting in cross-talk often occurring. The cross-talk leads to leakage luminance in a display device in which the FEC device is incorporated.

In view of the problem, it is proposed that an FEC device is constructed so as to permit emitters to be operated independent from each other when the short-circuiting occurs, as shown in FIG. 7. Such a proposal is disclosed in Japanese Patent Application Laid-Open Publication No. 284324/1992.

The FEC device proposed, as shown in FIG. 7, includes a silicon substrate 120, on which an insulating layer 121 is formed. The insulating layer 121 is provided thereon with a plurality of gate conductors 122 each formed at a central portion thereof with an aperture 123. The gate conductors 122 are connected through fusible resistance elements 126 of a reduced width to a common gate line 125, respectively. The apertures 123 each are formed therein with an emitter 124 of a conical shape.

In the FEC device thus constructed, when short-circuiting occurs between any of the emitters 124 and the gate electrode 122, a short-circuit current flows through the fusible resistance elements 126 of the emitter, to thereby cause Joule heat to be generated in the fusible resistance elements 126, resulting in the fusible resistance element 126 being instantaneously broken due to fusing. Thus, the gate conductor 122 short-circuited is separated from the gate line 125 serving as a feed line, to thereby be interrupted, whereas the remaining FECs free from short-circuiting are properly fed with electricity, resulting in carrying out normal operation.

Unfortunately, the FEC device of FIG. 7 exhibits a disadvantage that fusing of the fusible resistance element 126 causes a material of the element fused to scatter and travel to the normal FECs, to thereby enter into an aperture of each of the FECs, leading to additional short-circuiting.

Another disadvantage encountered with the FEC device is that it is highly difficult to form the fusible resistance element 126 of a width as small as submicrons for every gate conductor because a distance between the emitter and the gate conductor 112 is defined to be as small as submicrons, resulting in the fusible resistance element being often broken during manufacturing of the device.

SUMMARY OF THE INVENTION

The present invention has been made in view of the foregoing disadvantages of the prior art.

Accordingly, it is an object of the present invention to provide a field emission cathode device which is capable of separating a block including an emitter short-circuited from normal blocks when short-circuiting between the emitter and a gate conductor.

It is another object of the present invention to provide a field emission cathode device which is capable of preventing a material used for forming an FEC from scattering when it is fused.

In accordance with the present invention, a field emission cathode device of the Spindt type is provided. The FEC device includes a cathode conductor formed with cutouts, resistive layers provided in cutouts, respectively, a plurality of conical emitters formed on each of the resistive layers, and an insulating layer arranged on the cathode conductor and the resistive layers. A gate conductor is arranged on the resistive layers through the insulating layer so as to be positioned around a distal end of each of the conical emitters. The FEC device also includes a plurality of terminals for connecting each of the resistive layers to the cathode conductor. The terminals are fused by a short-circuit current flowing when short-circuiting between any of the emitters and the gate conductor occurs.

Also, in accordance with the present invention, a field emission cathode device is provided. The FEC device includes a substrate, a plurality of cathode conductors formed on the substrate in a stripe-like manner, a resistive layer arranged on the substrate so as to cover the substrate and cathode conductors, a plurality of emitters formed on the resistive layer, gate conductors arranged around a distal end of the conical emitters, and an insulating layer formed on the resistive layer. The gate conductors are arranged on the insulating layer, the insulating layer is formed at end edges thereof into a pectinate shape, and the resistive layer is so arranged that the pectinate end edges of the resistive layer are positioned on the cathode conductors.

In a preferred embodiment of the present invention, the gate electrodes are arranged in a stripe-like manner so as to be perpendicular to the cathode conductors.

BRIEF DESCRIPTION OF THE DRAWINGS

These and other objects and many of the attendant advantages of the present invention will be readily appreciated as the same becomes better understood by reference to the following detailed description when considered in connection with the accompanying drawing; wherein:

FIG. 3(*b*) is an enlarged plan view showing a portion of the field emission cathode device enclosed with a circle A in FIG. 3(*a*);

DETAILED DESCRIPTION OF THE PREFERRED EMBODIMENTS

Now, a field emission cathode device according to the present invention will be described hereinafter with reference to FIGS. 1 to 4(*e*).

Figure 1:
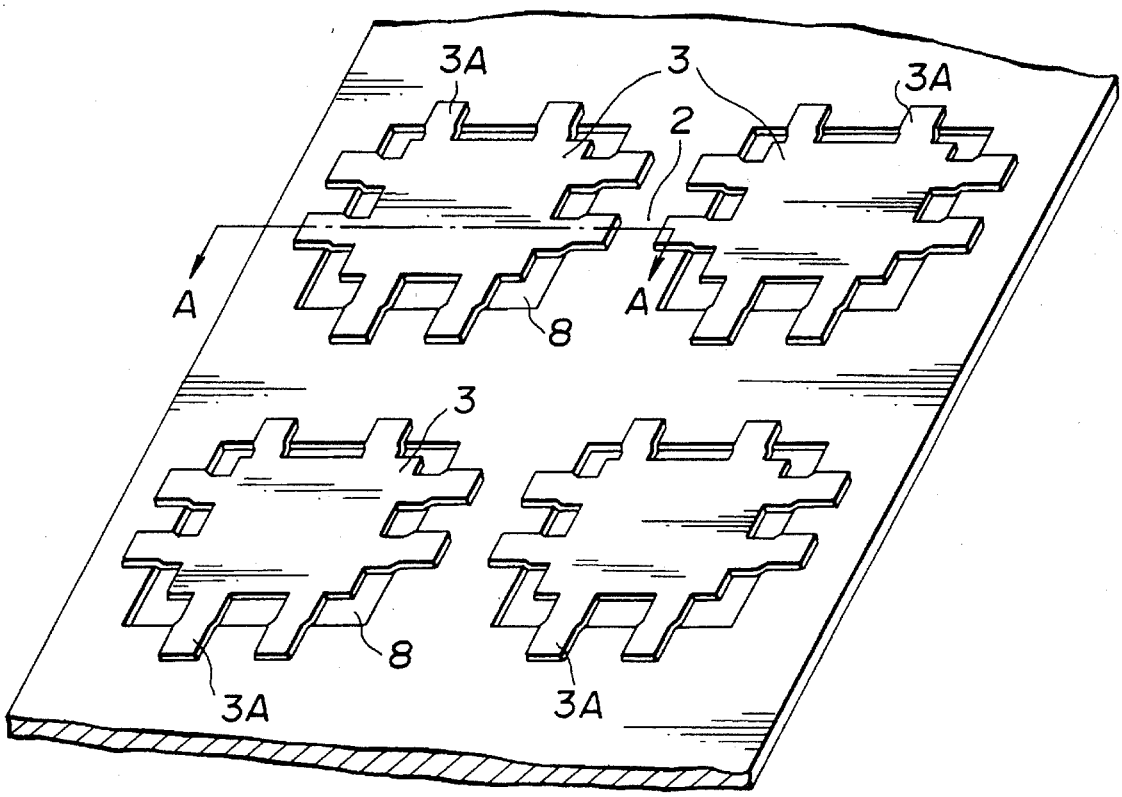
FIG. 1 is a perspective view showing an essential part of a first embodiment of a field emission cathode device according to the present invention.
Figure 2:
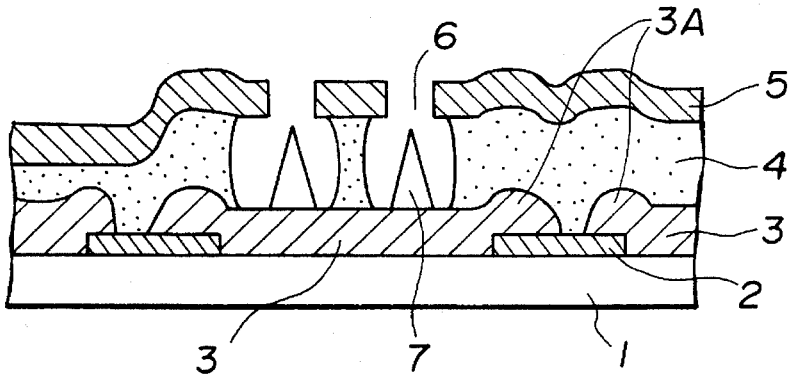
FIG. 2 is a sectional view taken along line A—A of FIG. 1.

Referring first to FIGS. 1 and 2, an embodiment of a field emission cathode device according to the present invention is illustrated.

In a field emission cathode device of the illustrated embodiment, a cathode conductor 2, as shown in FIG. 1, is formed with a plurality of rectangular cutouts 8, in each of which a resistive layer 3 of a rectangular shape is arranged. The rectangular resistive layers 3 each are provided on a periphery thereof with a plurality of terminals 3A in a manner to electrically connect the resistive layer 3 to the cathode conductor 2. In the illustrated embodiment, two such terminals 3A are arranged on each of sides of the resistive layer 3, thus, eight such terminals 3A are arranged for every resistive layer 3. The resistive layers 3 each are provided thereon with an FEC including a plurality of emitters 7 of a conical shape, resulting in providing an FEC device.

Now, the FEC device will be described hereinafter with reference to FIG. 2 which is a sectional view taken along line A—A of FIG. 1.

The cathode conductor 2 is arranged on an insulating substrate 1 and the resistive layers 3, as described above, each are arranged in each of the cutouts 8 of the cathode conductor 2 so as to extend at an end thereof to the cathode conductor 2. The cathode conductor 2 is formed thereon with a gate conductor 5 through an insulating layer 4. The gate conductor 5 and insulating layer 4 are commonly provided with a plurality of apertures 6 in a manner to commonly extend through the conductor 5 and layer 4. The apertures 6 each are provided therein with an emitter 7 of a conical shape. The gate conductor 5 is also arranged so as to be positioned through the insulating layer 4 above the cathode conductor 2.

In the FEC device thus constructed, when short-circuiting occurs between the gate conductor 5 and any of the emitters 7 in any of the FECs, an excessive amount of short-circuit current flows toward the resistive layer 3 on which the emitter is formed. Then, the current flows through the terminals 3A into the resistive layer 3, resulting in the terminals 3A of the resistive layer being successively broken due to fusing. Thus, the FEC device of the illustrated embodiment effectively prevents the short-circuiting from affecting operation of the remaining normal FECs of the FEC device. Also, each of the terminals 3A is covered with the insulating layer 4, so that a material of the fused terminals 3A is essentially prevented from scattering when fused terminals 3A are broken due to fusing, resulting in preventing secondary breakage of the remaining normal FECs.

Now, manufacturing of the FEC device of FIG. 2 constructed as described above will be described hereinafter.

First, the insulating substrate 1 which may be made of glass or the like is formed thereon with the cathode conductor 2. The cathode conductor 2 may be made of a film of a metal material such as Nb, Mo, Al or the like. Then, the cathode conductor 2 is formed with the rectangular cutouts 8 by photolithography. The cutouts 8 may be so formed that each of sides thereof has a length of 40 to 100 microns.

Subsequently, the resistive layer 3 is arranged in each of the cutouts 8. The resistive layers 3 each are formed into a thickness of 0.5 to 2.0 microns by sputtering or CVD techniques, to thereby cover the cathode conductor 2. The resistive layer 3 may be made of a material such as $In_2O_3$, $Fe_2O_3$, ZnO, Ni-Cr alloy, silicon doped with any impurity, or the like so as to exhibit resistivity of $1\times10^1$ to $1\times10^6$ Ωcm.

Then, the resistive layers 3 each are subject to a patterning treatment by wet etching using an alkaline solution such as ammonia or the like or a reactive ion etching (RIE) using fluorine gas, so that a plurality of the terminals 3A are formed around each of the resistive layers 3.

Thereafter, the insulating layer 4 is formed on the substrate 1 so as to cover the cathode conductor 2 and resistive layers 3. The insulating layer 4 may be made of a silicon dioxide film of about 1.0 micron in thickness by sputtering or CVD techniques. Then, the gate conductor 5 is formed on the insulating layer 5. The gate conductor 5 may comprise a film of Nb, Mo or the like having a thickness of about 0.4 micron which is formed by sputtering. The gate conductor 5 is then formed with a plurality of apertures 6 of about 1.0 micron in diameter, which are further formed so as to extend through the insulating layer 4 to the resistive layer 3 by wet etching using buffered hydrofluoric acid (BHF) or RIE using gas such as $CHFO_3$ or the like.

Subsequently, aluminum is deposited on the gate conductor 5 in an oblique direction by electron beam deposition, resulting in a peel layer being formed, followed by deposition of Mo in a vertical direction on the peel layer by EB deposition. This causes Mo to be deposited in a conical shape in each of the apertures 6, resulting in the emitter 7 of a conical shape being formed. Finally, the peel layer is removed by dissolution in a peel solution such as a phosphoric acid solution, resulting in such an FEC device as shown in FIG. 2 being provided.

As described above, in the illustrated embodiment, the terminals 3A constitute a fuse circuit which functions to permit, when short-circuiting occurs between the gate conductor and any emitter of any of the blocks, the block to be separated from the remaining blocks, to thereby prevent a failure of operation of the whole FEC device. Alternatively, the illustrated embodiment may be so constructed that in the case of an initial failure, a defect of one line of the cathode conductor is remedied at only a part of the blocks by cutting only the terminals of the block by means of an external laser beam.

Also, a plurality of the terminals are provided for every resistive layer 3. Such an arrangement of the terminals effectively restrains the FEC from being adversely affected by accuracy of a photomask, particles and dust produced during manufacturing of the FEC, and the like, to thereby prevent breakage or burnout of the FEC and improve yields thereof.

In the illustrated embodiment, a resistance value of the resistive layer 3 is determined depending on a width of the terminal 3A, so that the resistive layer 3 fails to exhibit a low resistance value.

Figure 3:
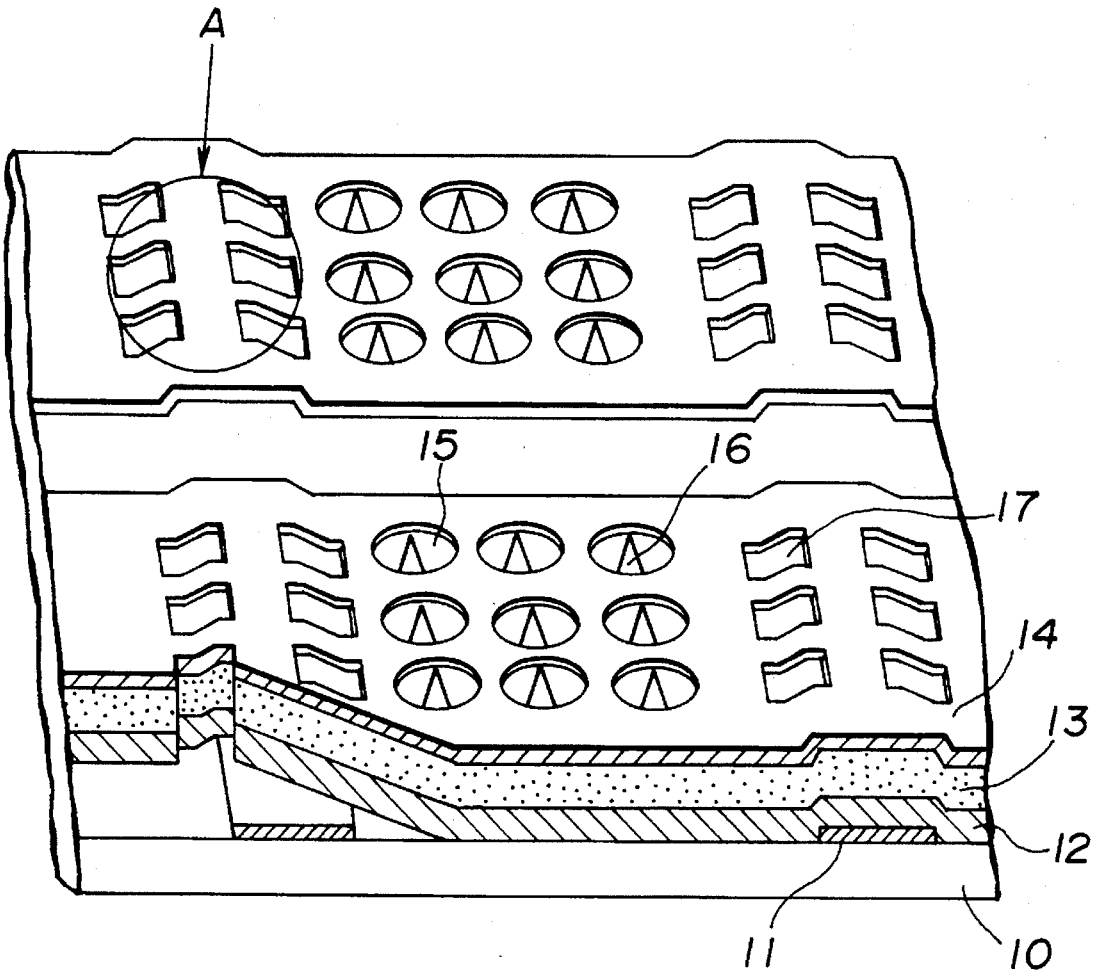
FIG. 3(*a*) is a perspective view showing a second embodiment of a field emission cathode device according to the present invention.
Figure 3:
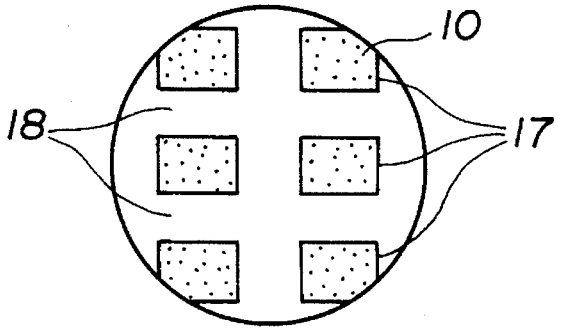

Referring now to FIGS. 3(*a*) and 3(*b*), a second embodiment of a field emission cathode device according to the present invention is illustrated, which is constructed so as to permit a resistive layer to exhibit a low resistance value.

A field emission cathode device of the second embodiment includes an insulating substrate 10 made of glass or the like and a plurality of, strip-like cathode conductors 11 arranged in a stripe-like manner at predetermined intervals on the substrate 10. Also, the field emission cathode device includes a resistive layer 12 on the cathode conductors 11 so as to cover both the substrate 10 and cathode conductors 11. The resistive layer 12 may be formed by vapor deposition of a suitable material such as, for example, amorphous silicon. Also, the resistive layer 12 is provided thereon with an insulating layer 13, on which a plurality of gate conductors 14 are arranged in a stripe-like manner so as to extend in a direction perpendicular to the cathode conductors 11.

The gate conductors 14 each are provided at a portion thereof interposed between each adjacent two of the cathode conductors 11 with a plurality of apertures 15, in each of which an emitter 16 of a conical shape is arranged while being positioned on the resistive layer 12. Reference numeral 17 designates a plurality of through-holes which are formed so as to extend through the gate conductor 14, insulating layer 13 and resistive layer 12 to the substrate 10 and arranged at predetermined intervals along both sides of each of the cathode conductors 11.

FIG. 3(*b*) is a fragmentary enlarged plan view showing a part of the FEC device enclosed, by a circle A in FIG. 3(*a*). As shown in FIG. 3(*b*), a part of the substrate 10 is exposed through the holes 17. More particularly, the holes 17 permit each of the cathode conductors 11 to be patterned in a pectinate manner, so that the resistive layer 12 and each of the cathode conductors 11 are connected to each other through a pectinate section 18 thus defined.

This permits each of the cathode conductors 11 to be located under the resistive layer 12 at the pectinate section 18, so that a resistance value of the resistive layer 12 is significantly decreased.

Now, manufacturing of the field emission cathode device of the second embodiment thus constructed will be described hereinafter with reference to FIGS. 4(*a*) to 4(*e*).

First, the insulating substrate 10 which may be made of glass or the like is provided thereon with a material for the cathode conductors 11. The material for the cathode conductors 11 is depositedly formed of metal such as Nb, Mo, Al or the like into a film of about 0.2 micron in thickness by sputtering or electron beam deposition. Then, the metal film thus deposited is formed thereon with resist layers 18, followed by photolithography processing, resulting in the cathode conductors 11 being provided in a stripe-like manner. When the cathode conductors 11 are made of Nb, it is then subject to etching.

Then, the resistive layer 12 is formed of amorphous silicon doped with P into a shape of a film having thickness of about 0.5 micron by plasma CVD or the like, resulting in the cathode conductors 11 being covered with the resistive layer 12. Then, a film of silicon oxide such as silicon dioxide or the like is deposited in a thickness of about 1.0 micron on the substrate 10 so as to cover the cathode conductors 11 and resistive layer 12 by plasma CVD, resulting in providing the insulating layer 13. Subsequently, a film of Nb or Mo for the gate conductors 14 is formed into a thickness of about 0.4 micron on the insulating layer 13 by sputtering or electron beam deposition, followed by formation of a peel layer 19 of aluminum or the like on the Nb or Mo film for the gate electrodes.

Thereafter, a resist layer 20 is formed on the peel layer 19, followed by pattering, so that the gate conductors 14 may be provided in a stripe-like manner so as to be perpendicular to the cathode conductors 11 and the apertures 15 and holes 17 may be formed. Then, the peel layer 19, gate conductors 14 and insulating layer 13 are subject to reactive ion etching (RIE) using $BCl_3$, $SF_6$, and $CHF_3$ and $O_2$, respectively, resulting in the resistive layer 12 being exposed through the apertures 15 and holes 17, as shown in FIG. 4(*b*).

Subsequently, a resist layer 21 is formed on the peel layer 19, resulting in covering the apertures 15 with the resist layer 21 while keeping the holes 17 exposed. Then, portions of the resistive layer 12 exposed through the holes 17 are subject to wet etching using KOH or a mixture of nitric acid and hydrofluoric acid or dry etching by RIE using $SF_6$, resulting in being removed as shown in FIG. 4(*c*). Then, unnecessary portions of the cathode conductors 11 are removed by dry etching using $SF_6$, so that the cathode conductors 11 may be formed into a pectinate shape.

Then, the resist layer 21 is removed, followed by formation of a resist layer 22 for carrying out patterning so as to cover the holes 17 while keeping the apertures 15 exposed. Then, deposition of a layer 23 of a material for the emitters 16 is carried out in a vertical direction by electron beam deposition. This results in the material being deposited on the resist layer 22 and peel layer 19, as well as the emitter 16 of a conical shape being formed on each of the portions of the resistive layer 12 positioned in the apertures 15 as shown in FIG. 4(*d*).

Figure 4:
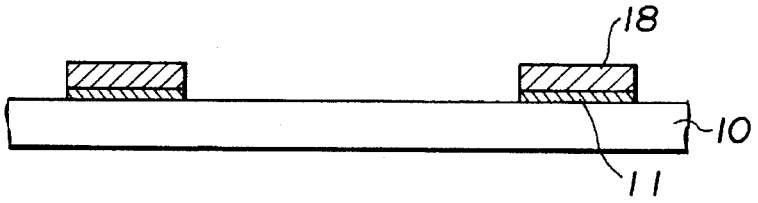
FIG. 4(*a*) to 4(*e*) each are a sectional view showing each of steps in manufacturing of the field emission cathode device of FIG. 3(*a*)
Figure 4:
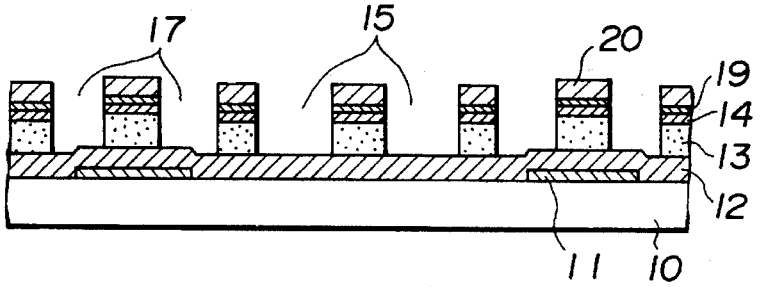
Figure 4:
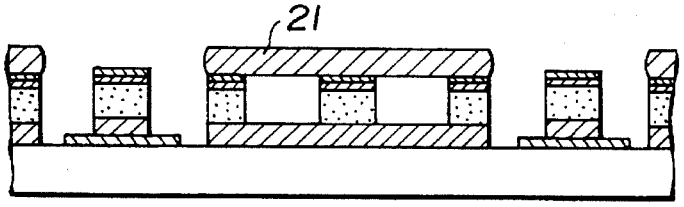
Figure 4:
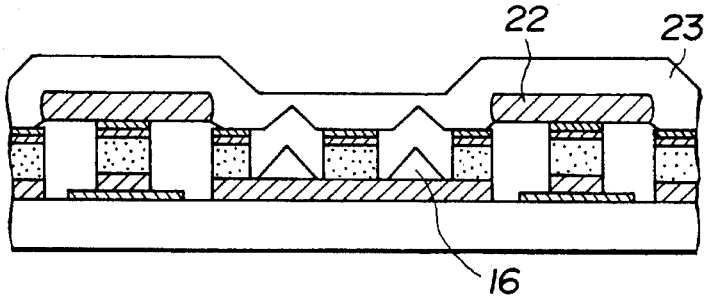
Figure 4:
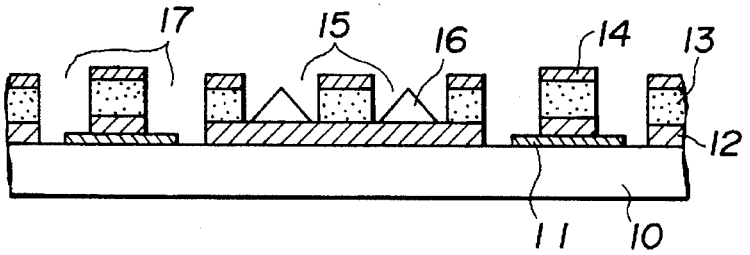
Figure 5A:
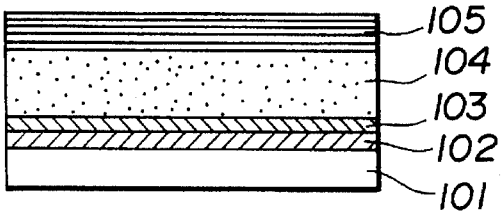
FIG.5(a) PRIOR ART
FIGS. 5(*a*) to 5(*f*) each are a sectional view showing each of steps in manufacturing of a conventional field emission cathode.
Figure 5B:
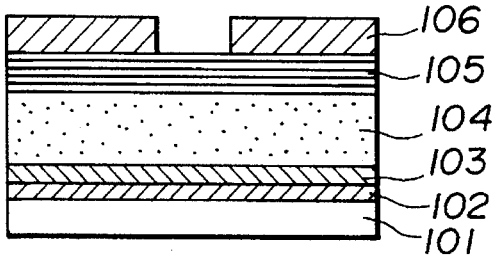
FIG.5(b) PRIOR ART
Figure 5C:
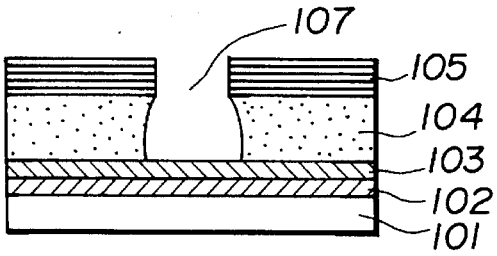
FIG.5(c) PRIOR ART
Figure 5D:
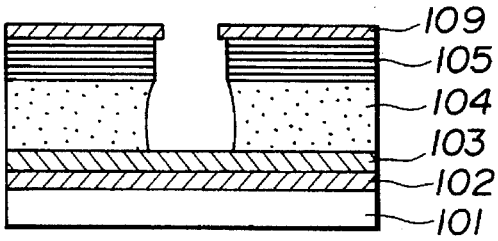
FIG.5(d) PRIOR ART
Figure 5E:
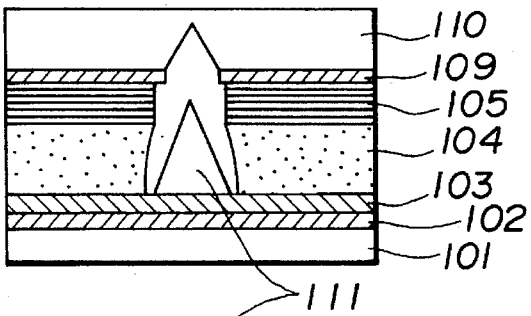
FIG.5(e) PRIOR ART
Figure 5F:
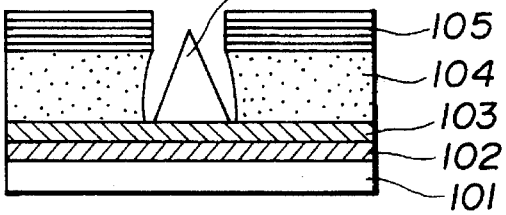
FIG.5(f) PRIOR ART
Figure 6:
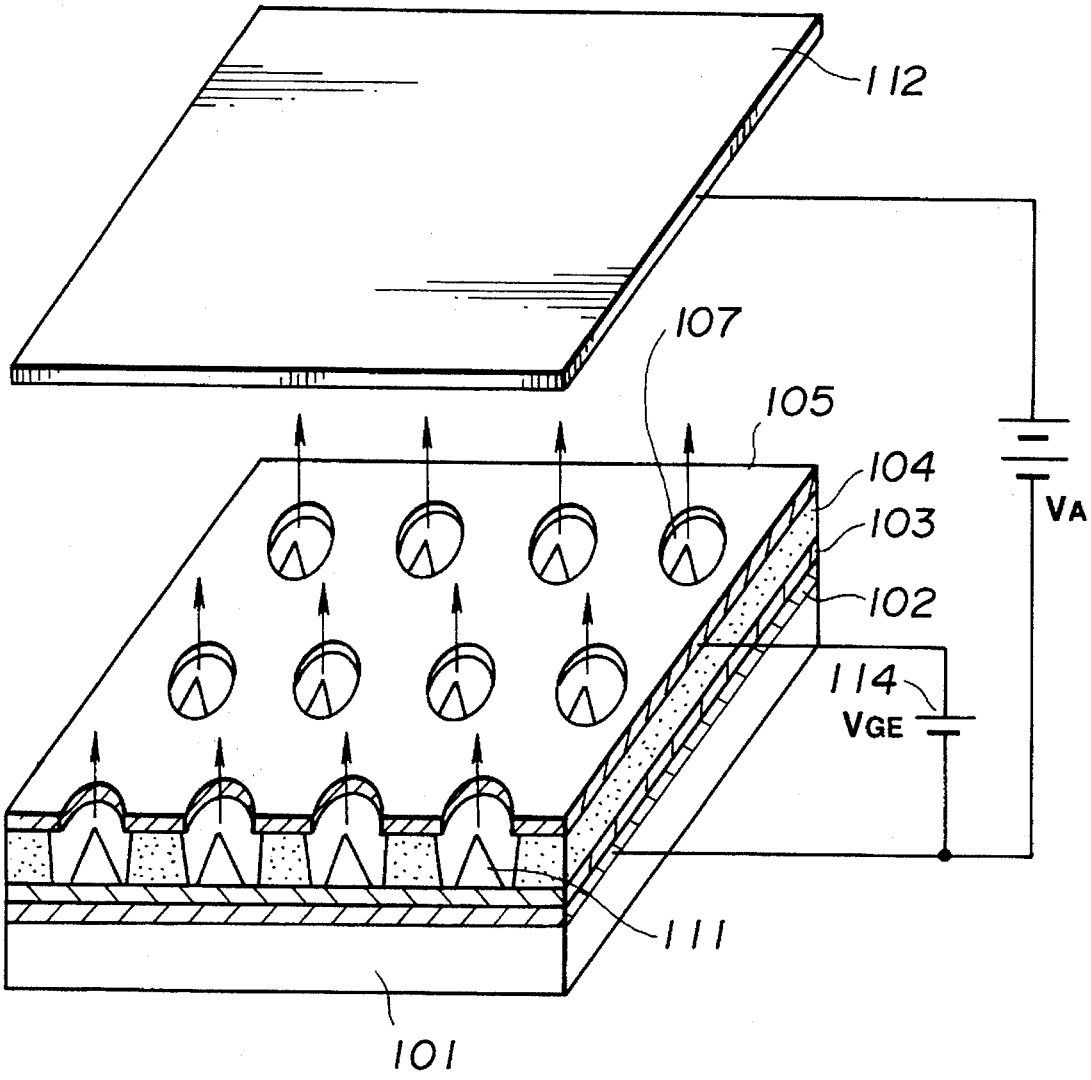
FIG.6 PRIOR ART
FIG. 6 is an exploded perspective view showing a conventional field emission cathode device.
Figure 7:
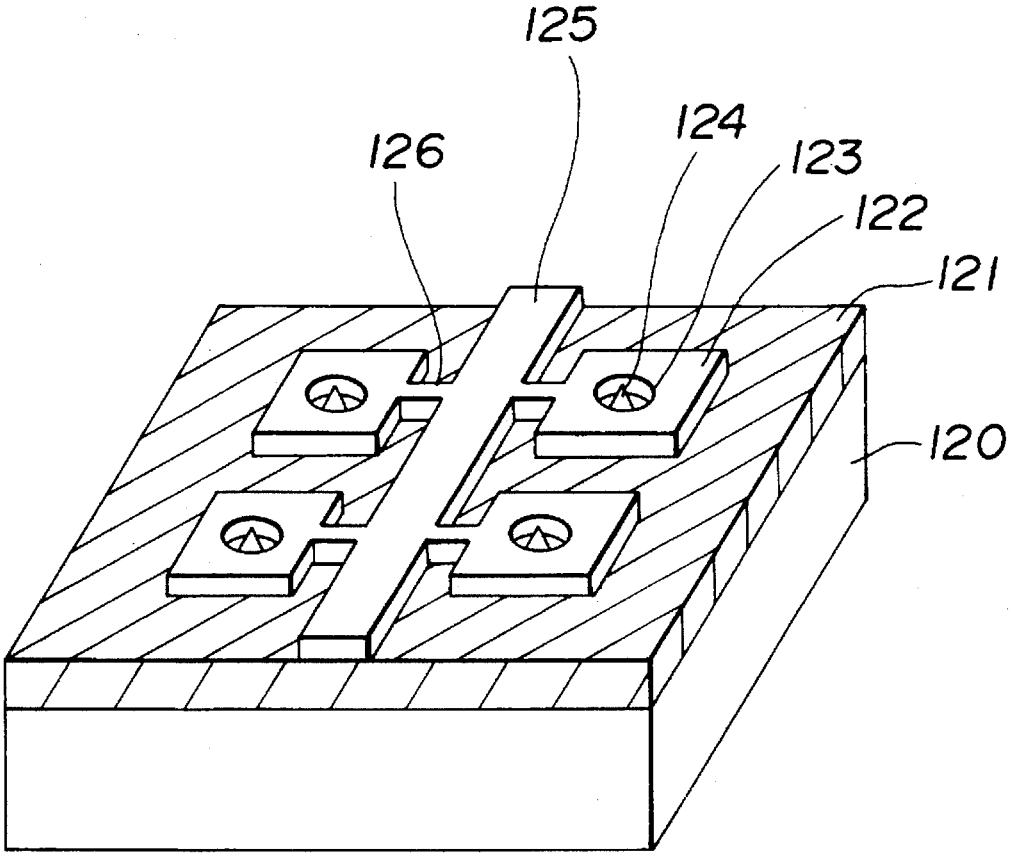
FIG.7 PRIOR ART
FIG. 7 is a perspective view showing another conventional field emission cathode device which is constructed so as to permit emitters to be independent from each other when short-circuiting occurs.

Then, the peel layer 19 of aluminum is removed by dissolution in a peel solution such as phosphoric acid or the like, leading to removal of the resist layer 22 and emitter material layer 23 as well, resulting in the FEC device being provided as shown in FIG. 4(*e*).

Thus, in the FEC device of the second embodiment, the connection between each of the cathode conductors and the resistive layer 12 is formed into a pectinate shape. By the way, when short-circuiting between at least one of the emitters of the FEC and the gate conductor causes an excessive amount of short-current to flow to the block in which the emitter short-circuited is formed. This causes the connection between the cathode conductor and the resistive layer connected to the block to be broken by Joule heat generated, so that the block is separated from the remaining normal blocks. Thus, only the defective block is rendered non-operative, so that the remaining normal blocks are effectively prevented from being adversely affected by the defective block. The resistive layer broken by fusing is substantially covered with the insulating layer, resulting in being prevented from scattering while being kept fused.

Also, the second embodiment may be constructed in such a manner that the cathode conductors each are previously formed into a pectinate shape and then the resistive layer is formed on the cathode conductors, followed by patterning of the resistive layer in conformity to the pectinate shape of the cathode conductors. Such a construction permits the cathode conductors and resistive layer to be connected to each other through the pectinate sections thus formed without providing the holes 17. Such an elimination of the holes 17 further restrains scattering of the fused resistive layer.

As can be seen from the foregoing, the field emission cathode device of the present invention including a plurality of the field emission cathodes (FECs) permits, when short-circuiting in any of the blocks, the defective block to be separated from the remaining normal blocks, resulting in effectively preventing the defective block from adversely affecting the normal blocks. Also, the resistive layer broken due to fusing when short-circuiting between the emitter and the gate conductor occurs is covered with the insulating layer, so that scattering of the fused resistive layer is effectively prevented, resulting in secondary breakage of the normal blocks due to the scattering being effectively prevented.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission cathode device of the Spindt type comprising:

a cathode conductor formed with cutouts;

resistive layers provided in said cutouts, respectively;

a plurality of conical emitters formed on each of said resistive layers;

an insulating layer arranged on said cathode conductor and said resistive layers;

a gate conductor arranged on said insulating layer so as to be positioned around a distal end of each of said conical emitters; and a plurality of terminals for connecting each of said resistive layers to said cathode conductor;

said terminals being fused by a short-circuit current flowing when short-circuiting between any of said conical emitters and said gate conductor occurs.

2. A field emission cathode device as defined in claim 1, wherein a plurality of said cutouts are provided for every picture cell.

3. A field emission cathode device as defined in claim 1, wherein said gate conductor is arranged in a stripe-like manner so as to be perpendicular to said cathode conductor.

4. A field emission cathode device comprising:

a substrate;

at least one cathode conductor formed on said substrate in a stripe-like manner;

a resistive layer arranged on said substrate and on said at least one cathode conductor so as to cover said substrate and said at least one cathode conductor;

a plurality of emitters formed on said resistive layer;

an insulating layer formed on said resistive layer;

gate conductors arranged on said insulating layer and around a distal end of said emitters;

a plurality of through holes formed through the gate conductors, insulating layer and resistive layer to the substrate and at sides of each of cathode conductor so that said gate conductors, said insulating layer and said resistive layer are formed at end edges thereof into a pectinate shape;

said resistive layer being so arranged that said pectinate end edges of said resistive layer are positioned on said cathode conductors.

5. A field emission cathode device as defined in claim 4, wherein said gate conductors are arranged in a strip-like manner so as to be perpendicular to said at least one cathode conductor.

* * * * *